US010905902B2

(12) United States Patent
Ehler et al.

(10) Patent No.: US 10,905,902 B2
(45) Date of Patent: Feb. 2, 2021

(54) BLOWER FILTER DEVICE, RESPIRATOR SYSTEM AND METHOD

(71) Applicant: Dräger Safety AG & Co. KGaA, Lübeck (DE)

(72) Inventors: Björn Ehler, Lübeck (DE); Thomas Pernot, Lübeck (DE); Achim Volmer, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 698 days.

(21) Appl. No.: 15/027,563

(22) PCT Filed: Oct. 6, 2014

(86) PCT No.: PCT/EP2014/002694
§ 371 (c)(1),
(2) Date: Apr. 6, 2016

(87) PCT Pub. No.: WO2015/051897
PCT Pub. Date: Apr. 16, 2015

(65) Prior Publication Data

US 2016/0236014 A1 Aug. 18, 2016

(30) Foreign Application Priority Data

Oct. 7, 2013 (DE) ..... 10 2013 016 600

(51) Int. Cl.
*A62B 7/10* (2006.01)
*A62B 9/00* (2006.01)
(Continued)

(52) U.S. Cl.
CPC ..... *A62B 7/10* (2013.01); *A62B 9/006* (2013.01); *A62B 9/02* (2013.01); *A62B 17/04* (2013.01); *A62B 18/006* (2013.01)

(58) Field of Classification Search
CPC ..... A62B 18/006; A62B 18/02; A62B 18/08; A62B 7/10; A62B 7/12
(Continued)

(56) References Cited

U.S. PATENT DOCUMENTS 5,189,350 A * 2/1993 Mallett ..... G01D 1/14 318/434
5,906,203 A 5/1999 Klockseth et al.
(Continued)

FOREIGN PATENT DOCUMENTS

EP 0 518 538 A2 12/1992
EP 1 197 244 A2 4/2002
(Continued)

*Primary Examiner* — Tu A Vo
*Assistant Examiner* — Alexander Morales
(74) *Attorney, Agent, or Firm* — McGlew and Tuttle, P.C.

(57) ABSTRACT

A fan filter device (50) for a respirator (1) includes an air inlet (54) for unfiltered air and an air outlet (56) for the discharge of filtered air. A fan unit (60), for aspirating air through the air inlet, includes a fan motor (62) and a fan sensor (64). The fan sensor is designed for detecting at least one operating parameter of the fan motor. The fan filter device further includes a filter unit (31) for receiving a filter (30) for filtering the aspirated air and an air flow sensor (58) for detecting at least one flow parameter of the filtered air flowing through the air outlet. A control unit (66) is configured to monitor the fan motor as a function of the at least one flow parameter and the at least one operating parameter. A respirator and method for operating such a fan filter device are also provided.

1 Claim, 4 Drawing Sheets

(51) Int. Cl.
*A62B 18/00* (2006.01)
*A62B 9/02* (2006.01)
*A62B 17/04* (2006.01)

(58) Field of Classification Search
USPC ..... 128/204.21, 204.18, 204.23; 96/424
See application file for complete search history.

(56) References Cited

U.S. PATENT DOCUMENTS 7,406,966 B2 * 8/2008 Wondka ..... A61M 16/06 128/204.18
9,119,979 B2 * 9/2015 Curran ..... A62B 7/10
2002/0062830 A1 5/2002 Meier et al.
2003/0019494 A1 * 1/2003 Bennett ..... A62B 18/006 128/204.14
2003/0180149 A1 * 9/2003 Krugerke ..... A62B 18/006 417/43
2004/0216740 A1 * 11/2004 Remmers ..... A61M 16/0045 128/204.18
2006/0065270 A1 * 3/2006 Li ..... A61M 16/0057 128/204.18
2006/0211981 A1 * 9/2006 Sparks ..... A61M 1/101 604/44
2007/0240719 A1 * 10/2007 Duarte ..... A62B 18/006 128/205.27
2008/0127979 A1 * 6/2008 Becker ..... A62B 17/04 128/205.27
2009/0136341 A1 * 5/2009 Kenyon ..... F04D 13/10 417/410.1
2010/0047089 A1 * 2/2010 Booker ..... F04D 13/10 417/410.1
2011/0146682 A1 6/2011 Patil et al.
2013/0087150 A1 4/2013 Palacharla et al.

FOREIGN PATENT DOCUMENTS

GB 2 472 592 A 2/2011
WO 00/27457 A1 5/2000

* cited by examiner

BLOWER FILTER DEVICE, RESPIRATOR SYSTEM AND METHOD

CROSS REFERENCE TO RELATED APPLICATIONS

This application is a U.S. National Phase Application of International Application PCT/EP2014/002694 filed Oct. 6, 2014, and claims the benefit of priority under 35 U.S.C. § 119 of German Patent Application DE 10 2013 016 600.4 filed Oct. 7, 2013, the entire contents of which are incorporated herein by reference.

FIELD OF THE INVENTION

The present invention pertains to a blower filter device for a respirator system, a respirator system with such a blower filter device and a method for operating a blower filter device.

BACKGROUND OF THE INVENTION

Respirator systems protect the user against particles, gases and/or vapors, which may compromise the quality of the breathing air and be harmful to health. A respirator system has at least one filter for filtering air and a breathing mask, to which the filtered air is fed. The breathing mask may be, for example, a hood, a helmet, a visor or even a full-face mask or half mask.

In order to provide especially reliable protection against contaminated air, blower-assisted respirator systems, which are designated as "PAPR" (Powered Air-Purifying Respirator) systems as well, additionally have a blower unit which has a blower and a motor for driving the blower. The blower unit aspirates the air filtered by the filter and generates discharged air, which is fed to the breathing mask. The blower unit is operated, such that an overpressure prevails in the breathing mask, so that only filtered air may escape from the breathing mask, but no contaminated air may penetrate into the interior of the breathing mask. Respirator systems with a blower filter device support the user by reducing the breathing resistance in contrast to conventional gas masks and thus make a long, fatigue-free use possible.

It is decisive for the breathing protection of a blower-assisted respirator system to rule out a vacuum in the breathing mask during the inhalation phase, which is achieved by feeding a defined constant volume flow of filtered air into the breathing mask. Thus, it is ensured that the inhaled air occurs exclusively by the feeding of air from the blower filter device and not from the contaminated environment due to possible leaks of the breathing mask proper, since excess air continually flows through the exhalation valve of the breathing mask into the environment.

For the open-loop control of the blower motor, it is known, from example, from EP 0 518 538 A2 to detect operating parameters of the blower motor and to provide corresponding characteristics, in order to obtain a defined air flow to the breathing mask. Such an open-loop control, however, has a relatively high inaccuracy, such that a correspondingly high air flow must be actuated to guarantee a minimum air flow, whereby the energy consumption of the blower motor is correspondingly high and the operating duration of a mobile respirator system is correspondingly short.

As an alternative, it is known to subject the blower motor to closed-loop control via sensors, which measure the air flow generated by the blower. Since respirator systems usually are used in harsh environments, the life of such sensors is comparatively short due to soiling and aging, and sensors have to be cleaned or replaced often, for example, to avoid malfunctions.

SUMMARY OF THE INVENTION

Thus, there is a need to further improve the operation of a blower-assisted respirator system, for providing a minimum air flow to the breathing mask of the user and to preferably make possible a long operating time.

In one aspect, the present invention pertains to a blower filter device for a respirator system with an air inlet for the inflow of unfiltered air and with an air outlet for the discharge of filtered air, with a blower unit for the aspiration of air through the air inlet, which comprises a blower motor and a blower sensor, whereby the blower sensor is designed for detecting at least one operating parameter of the blower motor, with a filter unit for receiving a filter for filtering the aspirated air, and with an air flow sensor for detecting at least one flow parameter of the air flowing through the blower unit. A control unit is provided and configured to control the blower motor as a function of the at least one flow parameter and of the at least one operating parameter.

By means of such a combined control of the blower motor, a high accuracy of the control can be achieved, on the one hand, by controlling via the flow parameter, as a result of which the energy demand of the blower motor is minimized for guaranteeing the minimum air flow and thus the operating duration of the blower filter device is extended. As an alternative, it is possible to reduce the weight of the blower filter device by means of a correspondingly reduced supply of energy, for example, in the form of small-sized batteries and thus to increase the carrying comfort of a corresponding respirator system.

For example, the air flow sensor may be a volume flow sensor, a mass flow sensor or a flow rate sensor, which is designed to detect the volume flow of filtered air flowing through the air outlet. The at least one blower sensor may be designed to detect, for example, a speed, a motor current and/or a motor output of the blower motor as an operating parameter or even combinations of motor current, motor output and speed. Such flow parameters may preferably be detected by such simple sensors as, for example, hot-wire anemometers, thermopile-semiconductor sensors, differential pressure sensors, fan-wheel anemometers or dynamic pressure probes and make possible a simple control of the blower motor with high accuracy. The speed may preferably be detected by such simple and robust measuring elements as, for example, magnetic field sensors (Hall sensors), motor current and/or a motor output are detected in a simple and robust manner, for example, by means of measuring elements for voltage and current measurement (current shunt, measuring amplifier, A/D converter). Thus, a simple and reliable control of the blower motor is made possible.

In a preferred embodiment, the air flow sensor is set up and/or arranged for detecting the at least one flow parameter of the air flowing through the air outlet. The arrangement of the air flow sensor for detecting the at least one flow parameter of the air flowing through the air outlet offers the advantage that the at least one flow parameter detects the flow situation, which corresponds to the flow situation at the air outlet and thus in the respirator system close to the site of the air feed to the user, so that, for example, the quantity of air actually fed to the user can be detected and/or balanced and smaller leaks upstream of the air flow sensor thus have only a slight error effect on the control of the blower motor.

In another preferred embodiment, the air flow sensor is set up and/or arranged for detecting the at least one flow parameter of the air flowing through the air inlet. The arrangement of the air flow sensor for detecting the at least one flow parameter of the air flowing through the air inlet offers the advantage that the at least one flow parameter detects a flow situation that corresponds to the flow situation at the air inlet, so that such flow effects of the blower unit as, for example, turbulences or swirls, as well as effects brought about due to such properties of the blower motor as, for example, pressure drop, have only a slight effect on the detection of the at least one flow parameter.

In the sense of the present invention, a control of the blower motor is defined as the quantity of air fed being controlled by the control unit, such that the quantity of air being fed is fed in a largely stable manner within a preset tolerance. For this purpose, in the sense of the present invention, this control may be designed as an open-loop control, a closed-loop control or as a setting of a preset value.

According to a preferred embodiment, the control unit is configured to perform a sensor check of the at least one air flow sensor, whereby the at least one operating parameter detected by the at least one blower sensor is compared with a reference value, especially a characteristic with a tolerance range, whereby the blower motor is subjected to closed-loop control as a function of the at least one flow parameter in case of agreement of the operating parameter with the reference value and is subjected to closed-loop control as a function of the at least one operating parameter in case of a deviation of the operating parameter from the reference value. In this way, an independent twofold control of the blower motor is carried out, whereby the more accurate control is carried out via the at least one flow parameter, preferably as a closed-loop control to the at least one flow parameter in the normal case, and the control via the at least one operating parameter of the blower motor is used for checking the function of the air flow sensor, on the one hand, and in case of failure of the air flow sensor, on the other hand.

Further, the control unit may be designed, such that, in the event of a deviation of the at least one operating parameter from the reference value, an indication is sent to a user. In this way, the user is warned in the event of a failure of the sensor. Since the function of the blower filter device is, furthermore, guaranteed by the control via the at least one operating parameter of the blower motor, the user can remove himself safely from the danger zone or finish his work in a remaining operating time and then carry out a cleaning and maintenance or a replacement of the air flow sensor. Thus, it is especially possible to utilize the maximum life of the air flow sensor.

For example, the control unit is configured to control the blower motor as a function of the flow parameter with a closed-loop control accuracy with less than 3% deviation.

In another aspect, the present invention pertains to a respirator system with a breathing mask with a discharge valve and an above-described blower filter device, whereby the blower unit of the blower filter is designed to send the filtered air flowing through the air outlet of the blower filter device to the breathing mask, whereby the control unit controls the blower motor, such that an overpressure is generated in the breathing mask compared to an ambient pressure.

In another aspect, the present invention pertains to a method for operating a blower filter device for a respirator system with the steps:

aspirate air through a blower unit with a blower motor,
determine an operating parameter of the blower motor,
filter the aspirated air,
determine a flow parameter of the filtered air, and
control the blower motor as a function of the at least one operating parameter and the at least one flow parameter.

A method with a combined control, by means of the at least one operating parameter of the blower motor and of the at least one flow parameter of the air flow, makes possible a reliable and energy-saving operation of a blower filter device for a respirator system with the above-mentioned advantages.

The method preferably comprises the checking of the air flow sensor for detecting the flow parameter of the filtered air, whereby the at least one operating parameter detected by the at least one blower sensor is compared with a reference value, especially a characteristic with a tolerance range, whereby the blower motor is subjected to a closed-loop control as a function of the at least one flow parameter in case of agreement of the operating parameter with the reference value and is subjected to a closed-loop control as a function of the at least one operating parameter in the event of a deviation of the operating parameter from the reference value and preferably an indication is sent to the user. The blower motor is advantageously subjected to a closed-loop control as a function of the flow parameter with a close-loop control accuracy with less than 3% deviation.

The flow parameter may be a volume flow and/or a mass flow of the filtered air. The operating parameter may be a speed of the motor, a motor current and/or a motor output of the blower motor.

The described method steps describe preferred embodiments of the operation of a blower filter device, but the present invention is not limited to the described sequence of the method steps. The described method steps may thus also be carried out in a different sequence; in particular, the steps of determining the operating parameter and the air flow parameter are not limited to the presently described sequence.

The embodiments described above may be combined with one another and with the aspects described above in order to achieve the advantages according to the present invention. Further features and advantages of the present invention appear from the preferred embodiments described as examples below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
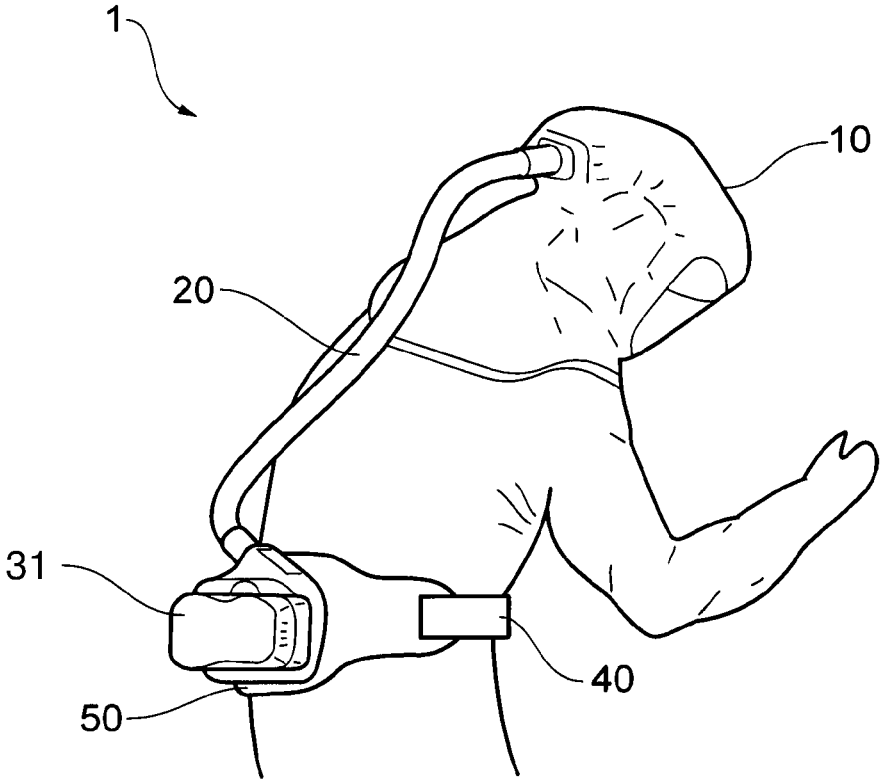
FIG. 1 is a perspective view of an embodiment of a blower-assisted respirator system according to the present invention.

Referring to the drawings, FIG. 1 illustrates a blower-assisted respirator system 1, which has a breathing mask 10, a tube 20, a filter unit 31, a carrying belt 40 and a blower filter device 50. The blower filter device 50 is secured on the carrying belt 40, which is carried by the user about the hip. The breathing mask 10 is designed as a hood or mask in the exemplary embodiment shown in FIG. 1. The breathing mask 10 is connected with the blower filter device 50 via the tube 20. The tube 20 may be designed as a pleated tube in order to make possible an improved freedom of movement for the user.

The soiled or contaminated air is aspirated by means of the blower filter device 50 through a filter 30, which is secured in a filter unit 31, as a result of which it is freed of harmful substances and is then guided via the tube 20 to the breathing mask 10 and fed to the user.

The respirator system 1 may also be designed in a different way. For example, the breathing mask 10 may cover only the face or a part of the face of the user. It is also possible that the blower filter device 50 and the filter 30 are arranged at another site, for example, directly at the breathing mask 10.

Figure 2:
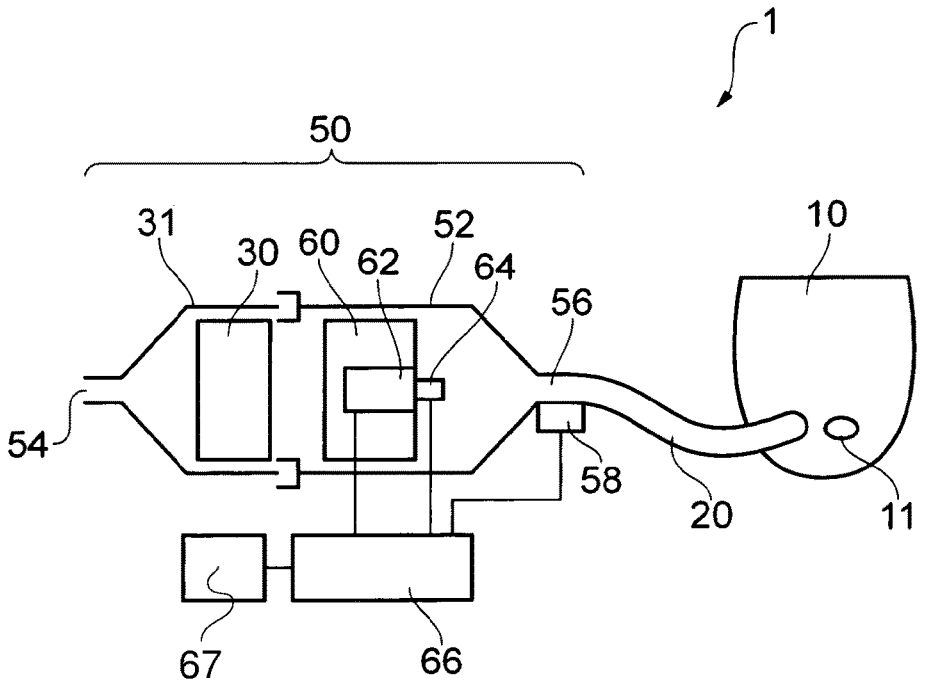
FIG. 2 is a detail view of a blower filter device of a respirator system according to the present invention.

FIG. 2 shows a schematic detail view of the respirator system 1 and of the blower filter device 50. The breathing mask 10 has a discharge valve 11, which is designed as a pressure valve in the embodiment shown and opens at a defined overpressure within the breathing mask 10 and lets air discharge from the breathing mask 10.

In the embodiment shown, the filter 30 and the filter unit 31 are integrated into the blower filter device 50. The blower filter device 50 has a housing 52, which forms an air inlet 54 and an air outlet 56. The housing 52 forms, in addition, with a housing component the filter unit 31, in which the filter 30 is secured. The housing 52 may also be set up in a different way.

An air flow sensor 58, which measures a flow parameter, for example, a volume flow or mass flow, of an air flow flowing through the air outlet 56, is arranged at the air outlet 56.

The blower filter device 50 further comprises a blower unit 60 for the aspiration of air through the air inlet 54 and the filter 30. The blower unit 60 has a blower motor 62 for driving a rotor and a blower sensor 64, which is designed for detecting at least one operating parameter of the blower motor 62. Operating parameters, which are detected by the blower sensor 64, are, for example, the speed N, the motor current I and/or the motor output P of the blower motor 62.

A plurality of air flow sensors 58 or blower sensors 64 may also be provided for detecting a plurality of flow parameters or operating parameters, respectively.

A control unit 66 is provided for controlling and/or closed-loop controlling and/or open-loop controlling the blower motor 62. The control unit 66 is configured to control the blower motor 62 as a function of the flow parameter detected by the air flow sensor 58 and of the operating parameter detected by the blower sensor 64.

In the preferred embodiment variants, a first control, preferably designed as a closed-loop control, is carried out via the flow parameter detected and an independent second control, preferably designed as an open-loop control, is carried out via the operating parameter detected and the two control mechanisms are combined, such that they can check one another for consistency and make possible an energy-saving operation of the blower filter device 50.

Figure 3:
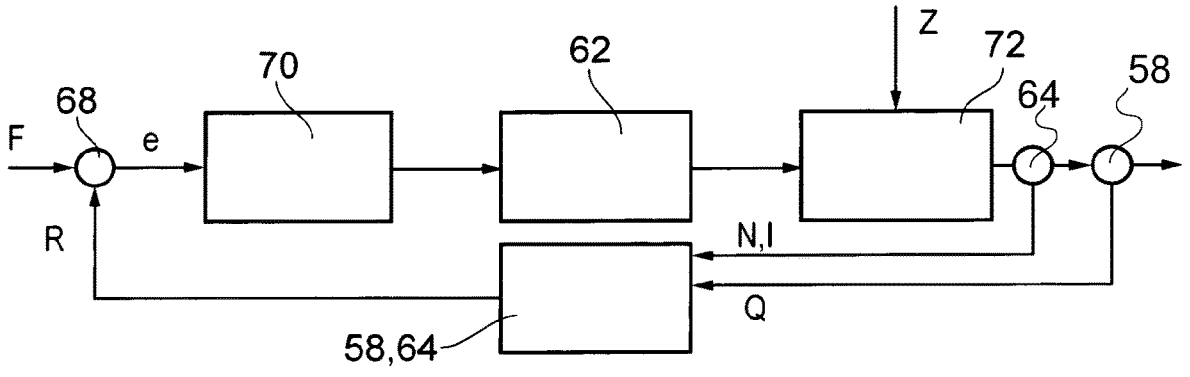
FIG. 3 is a diagram showing a control of the blower filter device with a control loop.

FIG. 3 shows a view of the open-loop control and closed-loop control mechanisms within the control unit 66 (FIG. 2), which is schematically shown as a simplified control loop. There is a clear connection between the volume flow (Q) as flow parameter and the speed (N) and the motor current (I) as operating parameters, which is utilized for the combined control. As an alternative, a clear connection between the volume flow (Q), speed (N) and motor output (P) may be utilized for the combined control.

A command variable F from an input unit 67 corresponds to a delivery capacity of the blower unit, which guarantees a defined minimum air flow into the breathing mash 10. At point 68, the command variable F is taken into account with a feedback variable R and resulting control deviation e is forwarded to a controller 70. The controller 70 forwards a corresponding manipulated variable to the blower motor 62. A control system 72 and the disturbance variable Z are especially determined by the flow resistance in the respirator system 1. Flow parameter Q and operating parameters N and I are determined as controlled variables by the air flow sensor 58 or the blower sensors 64, respectively. The results of the determination of the flow parameter and operating parameters are fed back as a feedback variable to the point 68 and taken into account with the command variable.

Figure 4:
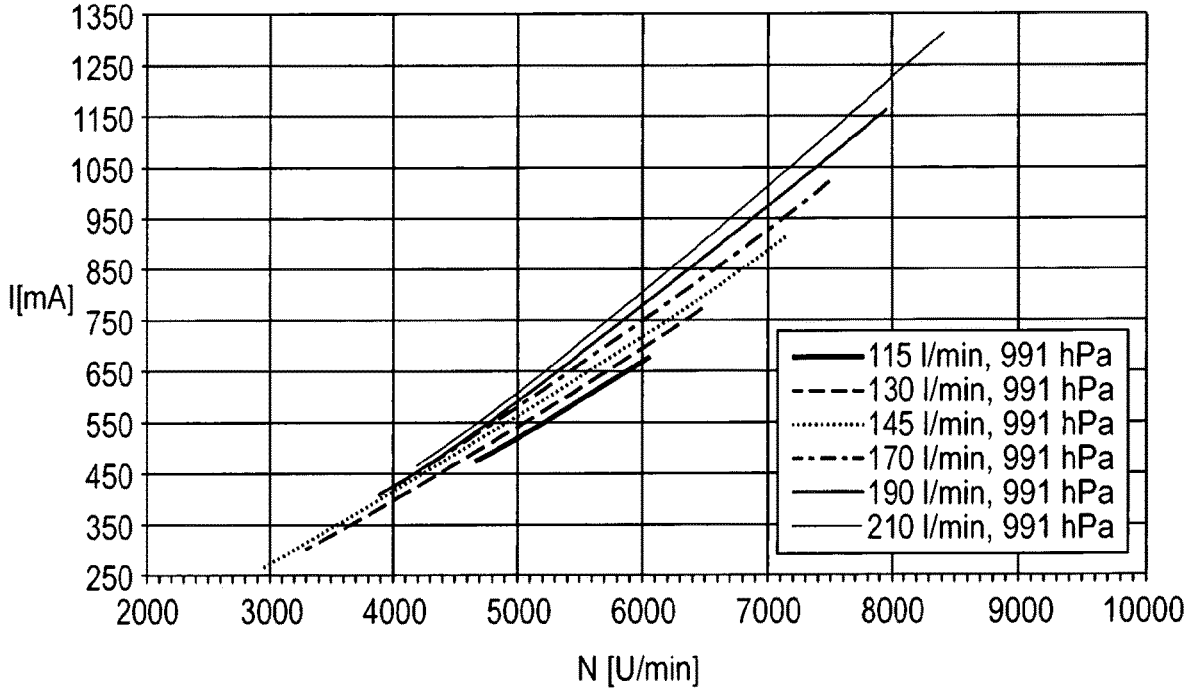
FIG. 4 is a graph showing a number of characteristics for the control of a blower filter device via operating parameters of a blower motor.

A control by means of the operating parameters N and I is described below on the basis of the example of FIG. 4. Should the volume flow be held constant, the control must drive the blower into a working point, which lies on the appropriate characteristic. FIG. 4 shows a number of characteristics for different volume flows.

This occurs in such a way that any motor current is initially selected as a starting value. Then, the speed, which is being set based on the pneumatic system resistance, is determined and consequently the motor current is varied, such that the deviation from the working point is minimized.

Nevertheless, the accuracy of a control of the volume flow of a blower filter device by means of characteristics is really inaccurate and can be determined, for example, from the motor values:

Speed N (max. 100007 min.)

Current consumption I (max. 1.3 A) or power consumption P (max. 13 W)

Motor voltage Vm (max. 12.6 V)

for the power consumption, the following applies:

$$P=\eta\cdot Q\cdot\Delta p \tag{1}$$

with Q=volume flow, Δp=differential pressure (via fan), η=efficiency (motor incl. fan impeller).

If the voltage is determined via a shunt in tandem to the load for the measurement of the power, the following applies to constant volume flow and efficiency (for slight deviations):

$$P\sim\Delta p \tag{2}$$

$$P=I\cdot Vm=Us/Rs\cdot Vm$$

When the shunt voltage Us at the shunt resistance Rs drops as well as $I=k_m\cdot M$ with M=motor torque and $k_m$=motor constant.

The current generates at the shunt resistance Rs the voltage $Us=I\cdot Rs=k_m\cdot M\cdot Rs$. If the voltage Us is determined with an A/D converter, the following applies to $U_{AD}$ and P:

$$U_{AD}=k_{AD}\cdot Us=k_{AD}\cdot k_m\cdot M\cdot Rs;\ k_{AD}=\text{converter constant}$$

$$P=I\cdot Vm=U_{AD}/Rs\cdot Vm=k_{AD}/Rs\cdot k_m\cdot M\cdot Rs\cdot Vm.$$

The tolerance for $k_m$ is typically ±10% for the blower motors, for $k_{AD}$=±2% (A/D conversion and reference) at constant torque M and for ΔVm=±2%. This results in the probable error:

$$\Delta P=(\Delta k^2_{AD}+\Delta k_m^2+\Delta Vm^2)=\pm 10.4\%.$$

In the event of a control of the motor based on the motor characteristics, this error would lead to an apparent change in the pressure difference being recognized via the fan. In order to compensate for this, the speed would be changed insofar as the volume remains constant. The volume flow Q would actually be changed by the same factor with the Δp deviation. This means that a tolerance of the volume flow of approx. ±10% is obtained.

In the control by means of the flow parameter (volume flow), carried out as a closed-loop control, on the other hand, a direct volume flow measurement shall be used as feedback signal in the control loop. Such a closed-loop control has a control accuracy which is dominated by the tolerance of the volume flow sensor. This preferably lies in a range less than 3% and is thus considerably more accurate than a control based on motor characteristics.

A safety margin is added to a minimal necessary volume flow preset value in order to compensate for the inaccuracies of the closed-loop control. However, it is preferably only as large as necessary in order to minimize the energy demand and thus to maximum the running time of the blower filter device 50. According to the preferred method variants, the closed-loop control by means of the flow parameter based on the increased accuracy is utilized for the closed-loop control of the blower motor.

In order to rule out a possible malfunction of the air flow sensor 58, a sensor check is carried out by using the defined operating parameters of the blower motor 62. In this way, a malfunction of the air flow sensor 58 due to soiling and for changing the properties due to aging is prevented.

Figure 5:
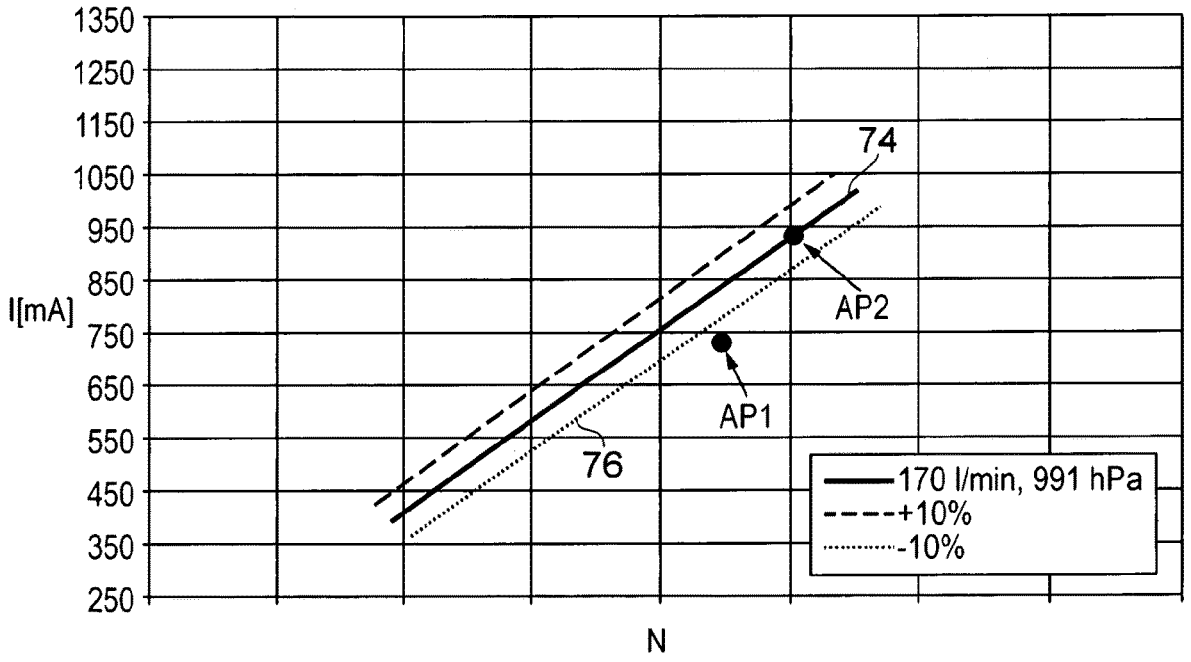
FIG. 5 is a graph showing a characteristic for the control of the blower filter device via operating parameters of the blower motor in case of checking a sensor function.

FIG. 5 shows the selected characteristic 74, which is associated with the selected volume flow, as well as a tolerance range of ±10% characterized by two other characteristics, which has especially a lower limit characterized by the line 76. The tolerance range determined by the two lines forms a reference value, in which the working point of the blower motor 62 lies, when the closed-loop control via the flow parameter is free from error. For the sensor check, the current working point in the characteristic field is periodically determined by determining the operating parameters N and I by the blower sensor 64 and compared with the reference value, whereby, for example, the minimal distance to the characteristic 74 is determined. If a too great distance is determined, then this is classified as an inconsistency of the sensor data and an error of the system is displayed by means of an optical, acoustic or tactile signal.

FIG. 5 shows an exemplary embodiment in which the blower unit 60 shall deliver a volume flow of 170 L/min. A tolerance envelope (tolerance range) of ±10% in relation to the volume flow is applied about the associated characteristic 74, i.e., a characteristic 76 each for 153 L/min. and 187 L/min. All working points within the tolerance envelope (tolerance range) thus provide for a volume flow with acceptable tolerance.

The working point AP1 in FIG. 4 lies outside this allowable tolerance envelope (tolerance range). This suggests an inconsistency. Such states provide for a signaling of a sensor error (volume flow sensor defective) and the switching over to characteristic control, as a result of which the working point AP2 is adjusted to the characteristic and the minimum volume flow is obtained again. This is dependent on the selection of the breathing mask 10 and is, for example, 115 L/min. for masks and 170 L/min. for hoods.

The user is made aware of the misconduct of the direct volume flow measurement by means of this measure, but is still not in a position to leave the contaminated area safely, without thereby having to accept heavy losses in terms of respiration protection. The user may consequently carry out a maintenance or a replacement of the air flow sensor 58. It is basically also possible for the user to continue his work, whereby the respiration protection is, moreover, guaranteed by the control via the operating parameters, but with a correspondingly higher energy demand and a correspondingly shorter operating duration.

Preferably, a defined minimum volume flow of filtered air is set, which shall be delivered by the blower filter device 50 to the breathing mask 10. It is also possible for a different flow parameter to be selected instead of the volume flow, for which a minimum value is set. The minimum value is, for example, dependent on the selection of the breathing mask or the working conditions.

A first set value for the combined control, which is dependent on the tolerance range of the air flow sensor 58, is determined as a function of the minimum volume flow. For the case of a tolerance range of ±3% of the air flow sensor, the first set value is set corresponding to 3% above the minimum volume flow.

The closed-loop control via the flow parameter is carried out by means of the first set value, as a result of which an energy-saving operation of the respirator system 1 is made possible. For the checking of the sensor function by means of the operating parameters of the blower motor 62, a first characteristic corresponding to the first set value is selected, which, with its tolerance range, forms a reference value for comparison with the operating parameters detected by the blower sensor 64.

Further, a second set value for the combined control as a function of the minimum volume flow is determined, which is dependent on the tolerance range of the blower sensors 64. For the case of a tolerance range of ±10% of the blower sensors, the second set value is set corresponding to 10% above the minimum volume flow and a corresponding second characteristic is selected.

For the case, in which a deviation of the working point, determined by the operating parameters, from the reference value (the first characteristic with its tolerance range belonging to the first set value) is established in the checking of the sensor function, the control is carried out by means of the operating parameters in the event of a sensor error of the air flow sensor 58 above the characteristic associated with the second set value.

While specific embodiments of the invention have been shown and described in detail to illustrate the application of the principles of the invention, it will be understood that the invention may be embodied otherwise without departing from such principles.

The invention claimed is:

1. A method for operating a blower filter device, the method comprising the steps of:

providing a filter;

providing a blower unit for flowing air through the filter, the blower unit including a blower motor;

operating the blower motor to flow air through the filter;

providing an air flow sensor for measuring a flow parameter of the air after flowing through the filter and being filtered;

providing a blower sensor configured to measure an operating parameter of the blower motor;

measuring the operating parameter of the blower motor with the blower sensor;

comparing the operating parameter with a tolerance range;

controlling the blower motor as a function of the flow parameter in case of agreement of the operating parameter with the tolerance range;

controlling the blower motor as a function of the operating parameter in case of deviation of the operating parameter from the tolerance range, said controlling as a function of the operating parameter being independent of the flow parameter; receiving a predetermined desired flow parameter; determining the tolerance range by defining acceptable values for the operating parameter corresponding to the desired flow parameter, and defining values outside the tolerance range indicating inconsistency of the flow parameter with the operating parameter.

* * * * *